US005349893A

United States Patent [19]

Dunn

[11] Patent Number: 5,349,893

[45] Date of Patent: Sep. 27, 1994

[54] IMPACT ABSORBING ARMOR

[76] Inventor: Eric S. Dunn, 810 Van Dyke La., Belair, Md. 21014

[21] Appl. No.: 838,018

[22] Filed: Feb. 20, 1992

[51] Int. Cl.[5] ..... F41H 1/02

[52] U.S. Cl. ..... 89/36.05; 2/2.5; 89/36.02; 428/911

[58] Field of Search ..... 109/82, 84; 2/2.5; 89/36.05, 36.02; 428/911

[56] References Cited

U.S. PATENT DOCUMENTS

| | | | |
|---|---|---|---|
| 3,577,836 | 5/1971 | Tamura | 89/36.05 |
| 3,649,426 | 3/1972 | Gates | 109/84 |
| 4,198,454 | 4/1980 | Norton | 109/84 |
| 4,529,640 | 7/1985 | Brown et al. | 109/82 |
| 4,566,237 | 1/1986 | Turner | 109/82 |
| 4,584,228 | 4/1986 | Droste | 428/911 |
| 5,139,596 | 8/1992 | Fell | 156/205 |

FOREIGN PATENT DOCUMENTS

| | | | |
|---|---|---|---|
| 432031 | 6/1991 | European Pat. Off. | 89/36.02 |
| 1042430 | 10/1958 | Fed. Rep. of Germany | 109/84 |
| 116685 | 11/1918 | United Kingdom | 89/36.02 |
| 577785 | 5/1946 | United Kingdom | 109/84 |

OTHER PUBLICATIONS

"Materials Selector," Materials in Design Engineering, Mid-October 1965, vol. 62, No. 5, pp. 444–445.

*Primary Examiner*—Stephen C. Bentley
*Attorney, Agent, or Firm*—John Lezdey

[57] ABSTRACT

The invention relates to an improvement in armor structures through the utilization of at least one panel capable of absorbing kinetic energy. The panel comprises a rigid structure having a multiplicity of joined polygonal cells having 3 to 8 sides throughout the panel. The cells have individual cell diameters of about 0.1 to 8.0 inches.

5 Claims, 3 Drawing Sheets

IMPACT ABSORBING ARMOR

FIELD OF THE INVENTION

The present invention relates to means for improving the impact resistance and kinetic energy absorption properties of armoring articles such as bullet-resistant vests, helmets, vehicular armoring components, structural building components and assemblies, etc. More particularly, there is provided a structure that when utilized by itself or in conjunction with conventional armor configurations and/or assemblies, will more effectively absorb and dissipate the impact energy from projectiles, fragments and missiles.

BACKGROUND OF THE INVENTION

Personal body armor has been utilized by military and law enforcement personnel as a means of providing personal protection from bullets, fragments and other missiles. Personal body armor designs and configurations must, due to their ultimate end-use, be both lightweight and flexible.

Personal body armor designs attempt to provide a lightweight flexible configuration that prevents penetration of the projectile into the human body and minimizes both backside armor deformation and the transfer of transfer of energy into the human body.

Traditional vehicular armor designs and configurations utilize rigid armor panels and/or plates constructed of a variety of materials including but not limited to metallic, ceramic, composite, fiberglass, nylon, aramid fiber and semi-crystalline polyolefin structures. Vehicular armoring materials and components must be lightweight structures capable of defeating anticipated projectile threats. The armor structures must transfer the kinetic energy inherent in the moving projectile so as to prevent penetration of the projectile and armor material spall (projectile and armor fragments) through the backside of the armor.

Vehicular armor designs attempt to provide lightweight configurations that prevent penetration of the projectile and resultant spall material through the backside of the armor. Vehicular armor structures are utilized on a variety of vehicles including but not limited to ground vehicles, aircraft, ships, etc.

All armor designs and configurations designed to defeat projectiles and missiles attempt to accomplish one or more of the following:

(1) Deform, bend, or dull incoming projectile to increase projectile area in contact with the armor in an effort to blunt and decelerate (2) Destabilize projectile by decelerating, deflecting, fracturing or changing projectile attitude (yaw)

(3) Utilization of armoring materials and thicknesses that constitute an overmatch condition. (Condition where projectile cannot possibly defeat or penetrate an armor configuration due to type and thickness of material.

Armor construction techniques also employ a layer of a finely divided substance within a shell of a hard or relatively hard material, such as, for example, to absorb effectively the kinetic energy of an impacting projectile. However, these techniques have not been entirely successful. Other techniques employ the use of a group of metallic members or the like which are retained within a metallic matrix for assisting in the deflection of a projectile from its predetermined path upon impact.

U.S. Pat. No. 2,723,214 teaches that in order for the armor to work effectively, at least the relatively small plates forming the outermost layer of the armor must be sufficiently rigid to prevent their being pierced or severely bent, so as to permit one of such plates when struck by a projectile, to move therewith in order to compress and thus transmit force through an adjacent layer of resilient material. It is asserted that as a result, kinetic energy of the projectile is converted into potential energy stored within the successively compressed layers of resilient material, which when forward movement of the projectile ceases, is reconverted into kinetic energy effective to accelerate the projectile in a reverse direction. Thus, it is suggested, the force transmitted to the wearer at the innermost surface of the armor is the residue of force which has not been absorbed by compression of the resilient layers, and that such residual force is transmitted to the wearer over a very large area, compared to the area of the small plate originally struck by the projectile.

However, it can be demonstrated that as a practical matter, armor of the type discussed above cannot be employed as flexible light weight armor, which is effective against hard nosed projectiles traveling at a high velocity. In this respect, it is well known that presently available materials when formed into a small sized plate of the type proposed for use in the outmost layer of such armor are unable to withstand without complete failure due to melting or fracture, the impact of a hard nosed projectile traveling at high velocity. Accordingly, when armor of this type is struck with a hard nosed high velocity projectile, at least a plate in the first and probably several succeeding layers of plates will fail and be completely deformed before sufficient kinetic energy is absorbed or converted to heat, acoustical and plate deforming energies in order to permit a plate in an intermediate layer of the armor to move along with the projectile without itself being deformed. This in effect requires that in order to reduce to a minimum the energy transferred through the armor to a wearer, the number of plates layers must be increased over that required if no plate were to fail. However, the number of plate layers which may be employed, is severely limited by the requirement that the armor be flexible and lightweight. The problem as to flexibility will be appreciated when it is considered that when, as suggested in U.S. Pat. No. 2,723,214, the individual plate areas of successive layers increases as by a factor of 4, the probable practical limit is about 5 plate layers before the armor surface adjacent a wearer would become substantially rigid.

Further, it has been found that normally resilient material, incorporated within a composite armor, when struck by a high velocity projectile, acts adjacent to the outwardly facing surface of the armor as a rigid body and thus does not elastically compress so as to readily absorb and convert kinetic energy of the projectile to potential energy.

U.S. Pat. No. 4,186,648 to Clausen et al, which is herein incorporated by reference, discloses an armor structure in which the structure of the present invention may be incorporated. This patent teaches the use of a plurality of woven fabric laminates of polyester resin fibers arranged and supported in and by a resinous matrix.

U.S. Pat. No. 2,697,054 to Dietz et al discloses laminated plastic structures especially adapted for absorption of kinetic energy of shrapnel or the like.

U.S. Pat. No. 4,732,944 discloses ionomer resin films which are sold under the trademark NOVIFLEX by Artistic Glass Products Company, which are used in the present invention.

SUMMARY OF THE INVENTION

The present invention relates to an improvement in armor structures. The improvement comprises the use of at least one panel capable of absorbing kinetic energy. The panel comprises a rigid metallic or high modulus synthetic resin structure having a multiplicity of joined polygonal cells having 3 to 8 sides. The cells have individual cell diameters of about 0.1 to 8 inches and are joined throughout the panel in a matrix to form a sheet of uniaxial cells.

Preferably, the cells of the panel are of a honeycomb configuration, (i.e. hexagonal matrix) and when used in connection with personal armor, the cells have a cell diameter of about 0.1 to 1 inch, a wall thickness of about 0.003 to 0.250 inch, preferably to about 0.03 inch, with a core thickness of about 0.025 to 12.0 inches, preferably up to about 3.0 inches.

Advantageously, the panel is used by incorporating it with an armor structure which forms a primary ballistic resistant outer layer (i.e. strike-face, impact side, attack side).

In the case of personal body armor designs and/or configurations, the panels are placed between or behind armor material layers to improve ballistic resistance performance and transfer impact energy over large areas. The panels are also used to provide an airspace gap between material elements and layers incorporated into the armor configuration/assembly. The presence of airspace gaps between individual armor materials and layers dramatically increases the ballistic resistance properties of the design. Panels of the invention are extremely lightweight and when used as an airspace filler, provide a means of unifying (fastening) multiple armor layers and materials.

The term "rigid" as used in the present specification and claims, is intended to include semi-flexible and semi-rigid structures that are capable of being free standing, without collapsing.

To form the improved armor structure of the invention, at least one substantially rigid layer is bonded to otherwise fastened to an existing armor structure. The resultant article is capable of standing by itself and is impact resistant. Where there is only one layer, the panel ordinarily forms a remote portion of the composite article, that is a portion that is not initially exposed to the environment, e.g., the impact of an oncoming projectile. Where there is more than one layer, a simple composite can be formed, for example, a panel of the invention is sandwiches between two layers, as is particularly useful, for example, in helmet applications. Other forms of the complex composite are also suitable, for example, a composite comprising multiple alternating layers of the panel and a rigid ballistic fabric layer.

To form the improved rigid vehicular and structural armor designs, one or more panels of the invention are bonded or fastened behind and parallel to the primary rigid armor material to reduce kinetic energy transfer, armor delamination and concentrated armor deformation. Panels of the invention may be used between successive armor layers or materials as an airspace gap. Airspace gaps between multiple layers of armoring materials is widely recognized as an effective means of minimizing energy transfer and the propagation of stress waves that prematurely fracture or destroy successive armor layers upon ballistic impact. Honeycomb panels provide a lightweight, structurally rigid air gap material that isolates and dissipates shock (stress wave propagation) and allows for the integral bonding of multiple material armor layers.

The term "needle penetration" as used herein refers to penetration by knives, ice picks, sharp-pointed instruments, shrapnel, and the like.

It is therefore an object of the invention to provide a kinetic energy absorbing panel for use in an armor structure.

It is a further object of the invention to provide a spacer to form an air gap in armor between different layers of armoring materials.

It is another object of the invention to provide an energy absorbing layer in light weight personal armor.

Other objects and a fuller understanding of the invention will be had by referring to the following description and claims of a preferred embodiment, taken in conjunction with the accompanying drawings, wherein like reference characters refer to similar parts throughout the several views.

DESCRIPTION OF THE PREFERRED EMBODIMENTS

Figure 1:
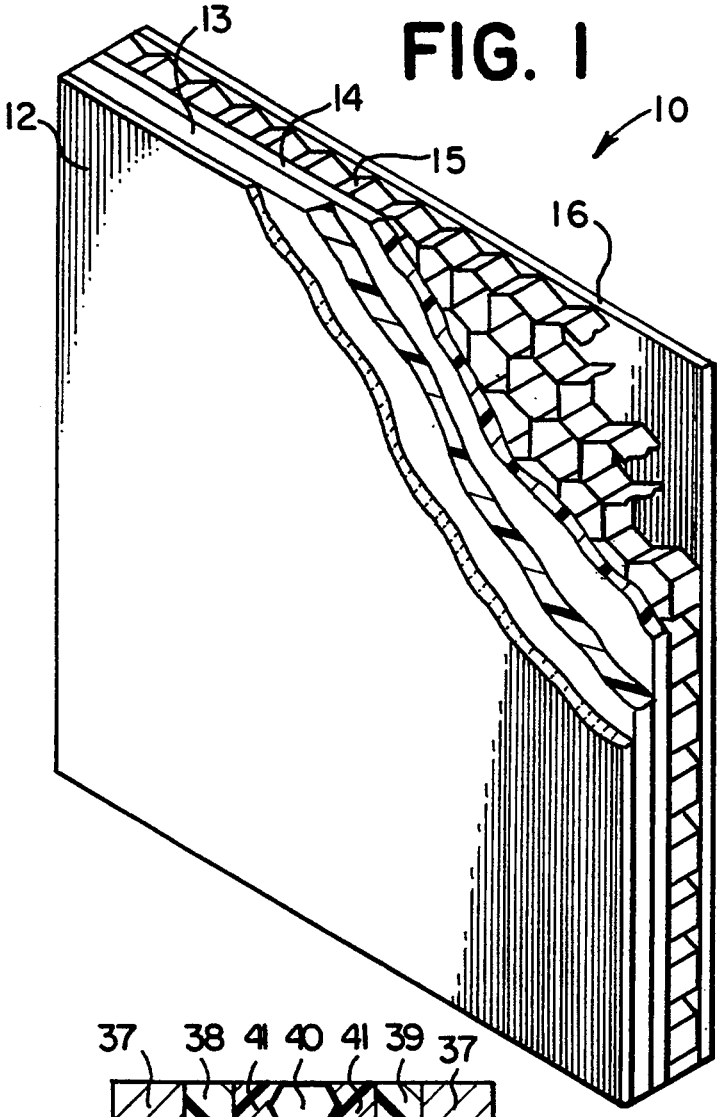
FIG. 1 is an elevational view, partly in section disclosing an armor laminate of the invention.

Although specific terms are used in the following description for the sake of clarity, these terms are intended to refer only to the particular structure of the invention selected for illustration in the drawings, and are not intended to define or limit the scope of the invention.

Figure 2:
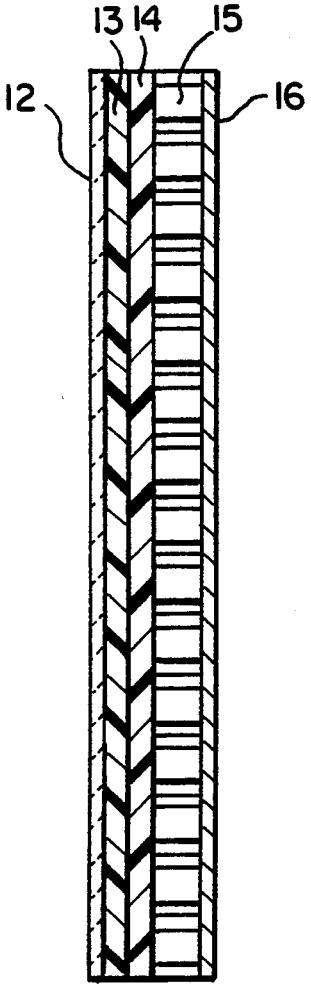
FIG. 2 is a side sectional view of the armor of FIG. 1.

Referring now to the drawings, as seen in FIG. 1 and 2, a light weight armor structure 10is shown which has been bonded to an outer metallic surface 12, for example, the body of a motor vehicle which forms the first impact zone. Adjacent surface 12 is a composite 13 which is comprised of a woven fiber in a resinous matrix. The resinous matrix may be the same or different from the resin.

The resin can comprise a high strength modulus resin such as ethylene-acrylate or methacrylate copolymers (SURLYN), vinyl ester phenolic, bismaleimide, polyamide, high strength medium modulus thermoplastics such as an ionomer (i.e. crosslinked ethylene-methyl acrylate or methyl methacrylate copolymer), polycarbonate, polyurethane, nylon, aramid, modified epoxies, or the like.

The addition of the fibers is usually sufficient to modify the modulus and elongation characteristics of the resin. Suitable fibers include fiberglass, carbon, polyester, nylon, aramid (i.e., TIVIRON, KEVLAR 29, KEVLAR 49 and KEVLAR 129), semi-crystalline polyolefins (i.e., SPECTRA semi-crystalline polystyrene and polyethylene), NORDYL, TORON, VECTRAN, TECHNORA can also be used.

The fibers which are utilized in the composite 13 may also comprise hybrids, for example, aramid and carbon; aramid and glass; aramid, carbon and glass; carbon, glass and Spectra, etc. Hybridization of the fibers not only reduces costs but in many instances improves the performance in armor structures. It is known that aramid fiber and carbon are significantly lighter than glass fiber. The specific modulus of elasticity of aramid is nearly twice that of glass, while a typical high tensile strength grade of carbon fiber is more than three times as stiff as glass in a composite. However, aramid fiber has a lower compressive strength than either carbon or glass, while carbon is not as impact resistant as aramid. Therefore, a hybrid of the two materials results in a composite that is (1) lighter than a comparable glass fiber-reinforced plastic; (2) higher in modulus, compressive strength, and flexural strength than an all-aramid composite; and (3) higher in impact resistance and fracture toughness than an all-carbon composite.

The layer 14 is a thermoplastic resin which preferably is an ionomer or a polycarbonate. A suitable ionomer is a crosslinked ethylene-ethylene acrylate copolymer sold under the trademark NOVIFLEX by Artistic Glass Products Company.

Adjacent layer 14 is the polygonal panel 15 having 3 to 8 sides of each cell. Preferably, the panel 15 comprises a honeycomb configuration. Suitable honeycomb panels may be obtained from Supracor Systems, Sunnyvale, Calif. and are sold under the trademark SUPRACOR. The honeycomb structure may be formed using adhesives, weld bonding or fusion bonding. The polygonal structures are rigid and are formed from a high modulus synthetic resin or metal. The cells of the polygonal panel may be closed, perforated, open, empty or filled. When the cells are open they act both as a kinetic energy absorber and as a spacer to provide an air gap. The direction of the cells depends upon the armor in which it is employed, the effect desired and the characteristic of the material within the core.

The metals used for the polygonal or honeycomb depends upon its use. For example, steel and the like are suitable for installations. Aluminum would be preferred for personal armor and aircraft. However, other metals can be readily determined for the different uses and environments that they are to be utilized.

Figure 3:
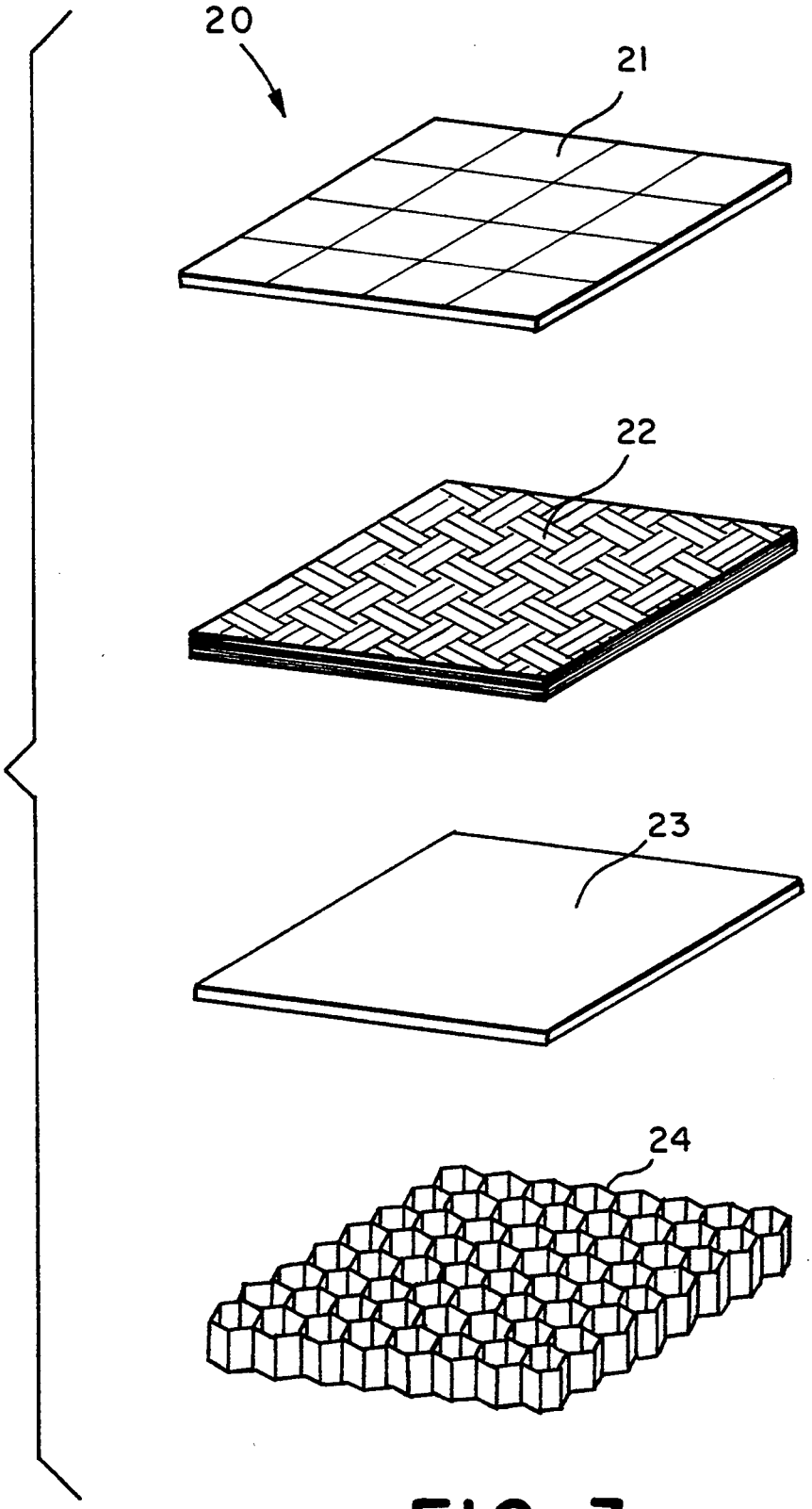
FIG. 3 is an exploded view of a further embodiment of the invention.

As shown in FIG. 3, there is provided an armor structure 20 which can be used to prepare light weight armor. The structure 20 is formed with an outer ceramic tile 21 which receives the initial impact. Ballistic material such as resinous composite 22 with polyethylene or aramid fibers is adjacent the ceramic tile for absorbing the major impact. Adjacent the composite 22 is a layer 23 of a thermoplastic, preferably, a polycarbonate or an ionomer. A semi-rigid honeycomb layer 24, preferably comprised of an aramid forms the inner layer and is used both as an energy absorber and as an air gap.

Figure 4:
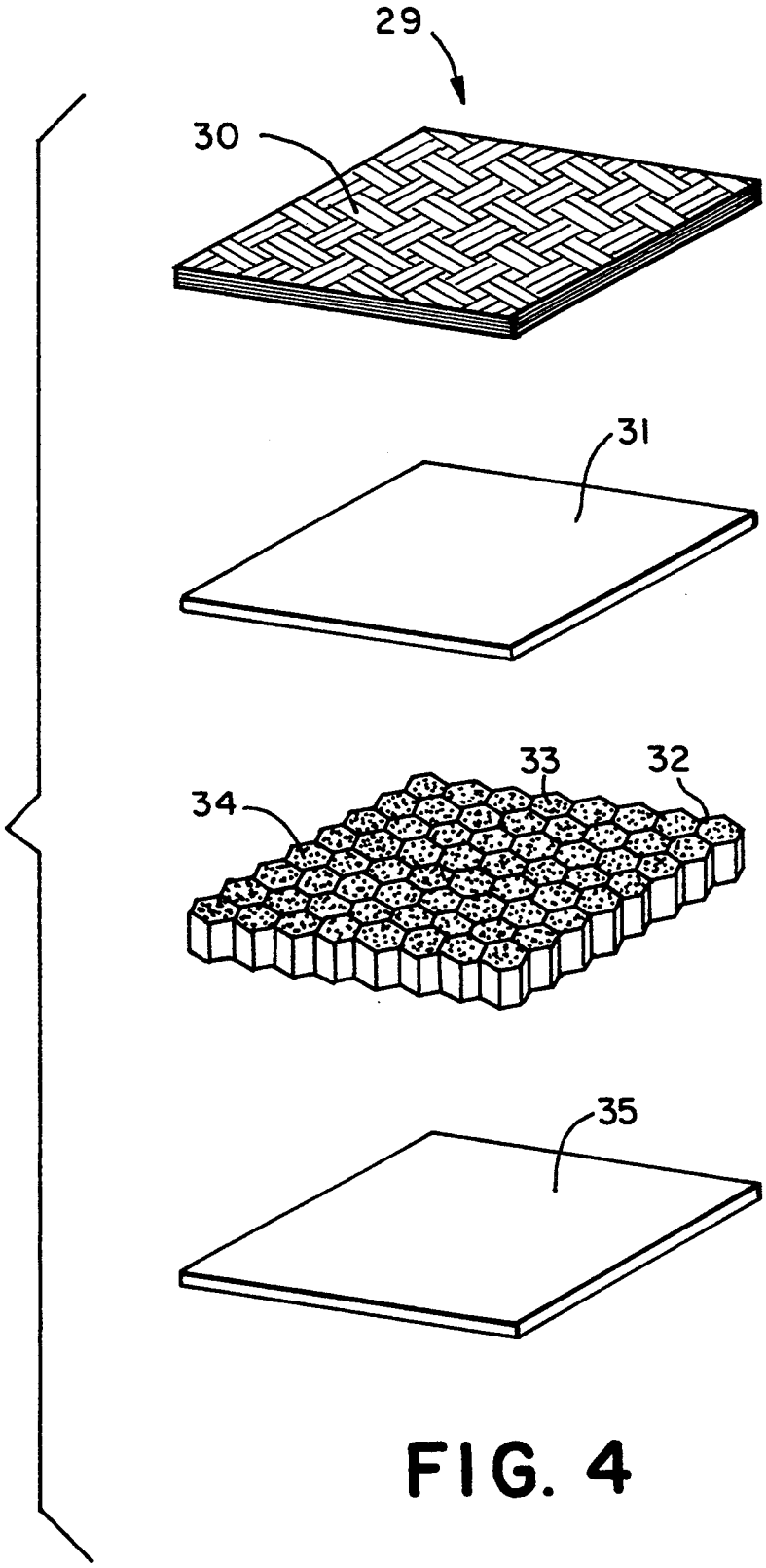
FIG. 4 is an exploded view of an another embodiment of the invention.

FIG. 4 discloses an armor composite 29 which is used to stop needle penetration. The composite 29 is formed with an outer ballistic fabric 30 comprising high modulus fibers and a thermoplastic resin. A polygonal panel 32 is sandwiched between two thermoplastic layers 31, 35 and attached to the ballistic fabric 30. The cells 33 of the polygonal panel 32 contain abrading material in the form of particles or grit which stops needle penetration.

Figure 5:
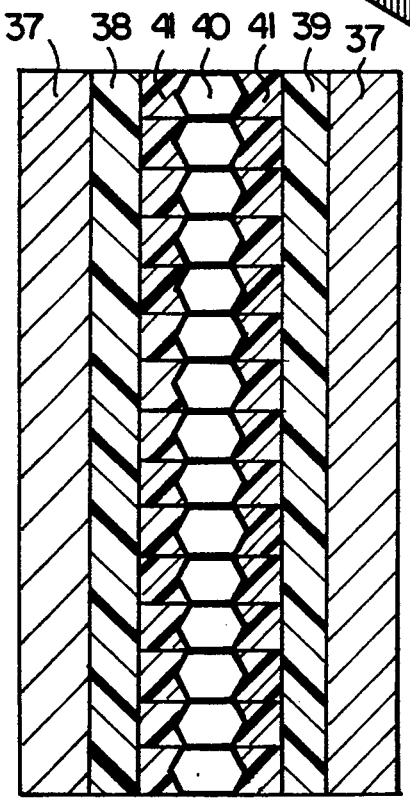
FIG. 5 is a side sectional view of an armor support laminate.

FIG. 5 illustrates an armor structure 36 which comprises an outer metal layer 37 that takes the initial impact. The adjacent layer 38 may comprise an armor fabric or a rigid thermoplastic sheet. A rigid thermoplastic layer 39 sandwiches a honeycomb panel 40 which contains the core section open or perforated in a direction away from the impact. The panel 40 may comprise a multiplicity of cells, for example, having a core diameter of about 0.125 inches, a wall gauge of about 0.012 inches and a core thickness of about 0.025 inches in the case of personal armor. The panel 40 is adhered to the layers 38,39 by means of a thermoplastic elastomer 41.

The particles, grit, or tiles and the like may be formed of any suitable metallic or ceramic materials. The particles, grit, or the like configured materials preferably overlap each other to prevent needle penetration. The particles or grit are preferably about −10 to −3 mesh.

The ceramic materials which can be utilized in the present invention comprises the oxides or mixtures of oxides, of one or more of the following elements: magnesium, calcium, strontium, barium, aluminum, scandium, yttrium, the lanthanides, the actinides, gallium, indium, thallium, silicon, titanium, zirconium, hafnium, thorium, germanium, tin, lead, vanadium, niobium, tantalum, chromium, molybdenum, tungsten, and uranium. Compounds such as the carbides, borides and silicates of the transition metals may also be used. Other suitable ceramic materials which may be used are zircon-mullite, mullite, alpha alumina, magnesium silicates, zircon, petalite, spodumene, cordierite and alumino-silicates. Suitable proprietary products are "MATTECEL" (trade name) supplied by Matthey Bishop, Inc., "TORVEX" (registered trademark) sold by E. I. Du Pont de Nemours & Co., "Wi" (trade name) sold by Corning Glass and "THEECOMB" (registered trademark) sold by the American Lava Corporation. Another useful product is described in British Patent No. 882,484.

Other suitable active refractory metal oxides include for example, alumina, titania, hafnia, thoria, zirconia, magnesia or silica, and combination of metal oxides such as boria-alumina or silica-alumina. Preferably the active refractor oxide is composed predominantly or oxides of one or more metals of Groups II, III, and IV of the Periodic Table.

Among the preferred abrading compounds may be mentioned YC, $TiB_2$, $HfB_2$, WC, $VB_2$, VC, VN, $NbB_2$, NbN, $TiB_2$, $CrB_2$, $MoB_2$, $W_2B$, and S-2 glass, for example, steel, Ni, Ti; and the like.

Thus, according to the present invention, the maximum stopping power per given weight and thickness is achieved when the impact energy inherent in a missile or projectile is spread laterally as quickly as possible. The faster and more effectively this is performed, the less the force per unit area that each successive zone or layer is subjected. By the present arrangement the maximum force is converted into deflection and dampening rather than impact injury or penetration through all of the layers of the armor structure.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. In light weight personal body armor having layers of material capable of resisting projectile penetration, the improvement which comprises a panel on the innermost side of said armor for absorbing and distributing kinetic energy, said panel comprising a pair of sheets of an ionomer and a rigid thermoplastic structure between said sheets having a multiplicity of joined polygonal cells of a honeycomb structure forming a sheet of uniaxial cells with a wall-thickness of about 0.003 to 0.250 inch and a cell diameter of about 0.1 to 1 inch.

2. The armor structure of claim 1 wherein said cells of said panel are open in the direction of impact.

3. The armor structure of claim 2 wherein said cells of said panel are of a honeycomb configuration.

4. The armor structure of claim 1 wherein said polygonal cells are fusion bonded.

5. The armor structure of claim 1 wherein said polygonal cells contain inorganic grit in an amount sufficient to prevent needle penetration.

* * * * *